US006893206B2

(12) United States Patent
Talaski

(10) Patent No.: US 6,893,206 B2
(45) Date of Patent: May 17, 2005

(54) MULTI-STAGE FUEL PUMP

(75) Inventor: Edward J. Talaski, Caro, MI (US)

(73) Assignee: TI Group Automotive Systems, L.L.C., Warren, MI (US)

( * ) Notice: Subject to any disclaimer, the term of this patent is extended or adjusted under 35 U.S.C. 154(b) by 66 days.

(21) Appl. No.: 10/431,259

(22) Filed: May 7, 2003

(65) Prior Publication Data

US 2004/0223842 A1 Nov. 11, 2004

(51) Int. Cl.[7] ..... F04D 5/00
(52) U.S. Cl. ..... 415/55.6
(58) Field of Search ..... 415/55.1–55.7

(56) References Cited

U.S. PATENT DOCUMENTS 2,340,787 A * 2/1944 Zenner et al. ..... 415/55.6
3,477,636 A * 11/1969 Gessner ..... 415/55.6
4,209,284 A * 6/1980 Lochmann et al. ..... 415/55.6
4,445,821 A 5/1984 Watanabe et al.
5,257,916 A 11/1993 Tuckey
5,340,284 A 8/1994 Nicol
5,642,981 A * 7/1997 Kato et al. ..... 415/55.1
6,162,012 A 12/2000 Tuckey et al.

FOREIGN PATENT DOCUMENTS

JP 58013189 A * 1/1983 ..... F04D/5/00

* cited by examiner

*Primary Examiner*—Edward K. Look
*Assistant Examiner*—Richard A. Edgar
(74) *Attorney, Agent, or Firm*—Reising, Ethington, Barnes, Kisselle, P.C.

(57) ABSTRACT

A multi-stage fuel pump has a drive assembly, a pump assembly including first and second pumping elements disposed between various plates of the pump assembly, and first and second pumping channels each having an inlet and an outlet circumferentially offset from the inlet and the outlet of the other pumping channel. Desirably, the pumping channels are offset to control or orient the forces acting on the drive assembly, pumping elements and the plates of the pump assembly, including radial, axial and torsional forces.

20 Claims, 6 Drawing Sheets

MULTI-STAGE FUEL PUMP

FIELD OF THE INVENTION

The present invention relates generally to fuel delivery systems and more particularly, to a fuel pump.

BACKGROUND OF THE INVENTION

Electric motor fuel pumps have been widely used to supply the fuel demand of an operating engine, such as in automotive applications. These pumps may be mounted directly within a fuel supply tank and have an inlet through which fuel from the tank is drawn into the fuel pump and an outlet through which fuel is discharged under pressure for delivery to the engine. The electric motor in the pump typically includes a rotor mounted for rotation about its axis in a housing in response to application of electrical power to the motor. In so-called turbine-type fuel pumps, the motor drives an impeller for rotation to increase the pressure of fuel and deliver it to the engine. One example of a turbine-type fuel pump is illustrated in U.S. Pat. No. 5,257,916.

In general, it may be desirable to reduce leakage in the pump assembly to improve the efficiency of the pump. However, reducing leakage generally requires manufacturing the pump to tighter or smaller tolerances and that leads to increased costs and difficulties in manufacturing the pump assembly. For example, a typical pump assembly has an impeller with opposed generally planar faces disposed between two plates each having a generally planar face adjacent to the impeller. To reduce leakage between the impeller and the plates, the clearance between their adjacent faces must be made small. However, reducing the clearance between the plates and the impeller can unduly increase the friction between them and thereby affect the performance of the fuel pump. Accordingly, various methods have been employed to control the relative spacing between the impeller and the plates including lapping of one or more of the planar surfaces to insure compliance with strict tolerances, and grinding of the periphery of the impeller or other adjacent surfaces to insure their size and shape are within the closely held tolerances.

An additional factor to be considered in the manufacture and assembly of the fuel pump assembly is that the pressure of the fuel between the inlet and outlet of the pumping assembly is varied. At the inlet, the pressure may be at or below atmospheric pressure, while at the outlet the pressure may be substantially above atmospheric pressure and, for example, on the order of 40–80 psi or higher. Accordingly, the forces acting on the impeller and the rest of the pumping assembly vary greatly as a function of the pressure of fuel in the various regions of the pumping assembly. The varied forces across the impeller and the pumping assembly as a whole produce side loading and torque on a shaft that drives the impeller as well as a tendency to displace the pumping elements and adjacent plates thereby increasing friction between them. These conditions also occur in so-called two stage fuel pumps that have two pumping elements arranged in series.

SUMMARY OF THE INVENTION

A multi-stage fuel pump has a drive assembly, a pump assembly including first and second pumping elements disposed between various plates of the pump assembly, and first and second pumping channels each having an inlet and an outlet circumferentially offset from the inlet and the outlet of the other pumping channel. Desirably, the pumping channels are offset to control or orient the forces acting on the drive assembly, pumping elements and the plates of the pump assembly, including radial, axial and torsional forces.

Typically, the drive assembly includes an electric motor that drives the pumping elements for rotation between the plates via a shaft connected to the pumping elements. The varying pressure in the pumping channels, from the low pressure at the inlet to a higher pressure at the outlet, produces radial or side loading on the shaft which can affect the efficiency of the fuel pump. Accordingly, circumferentially offsetting the first and second pumping channels can help to offset the side loading on the shaft, in addition to offsetting the forces acting on the pumping elements and plates, to increase the efficiency of the fuel pump.

Some objects, features and advantages of the invention include providing a fuel pump that has improved bearing durability, can be utilized in higher pressure fuel systems, can be manufactured and assembled at reduced cost, can be manufactured with larger tolerances, can utilize a less expensive motor shaft, is of relatively simple design, has improved efficiency, and has a long, useful life in service. Of course, other objects, features and advantages will be apparent to those skilled in the art in view of this disclosure. And fuel pumps embodying the invention may achieve more or less than the noted objects, features or advantages.

BRIEF DESCRIPTION OF THE DRAWINGS

These and other objects, features and advantages of the present invention will be apparent from the following detailed description of the preferred embodiments, appended claims and accompanying drawings in which:

DETAILED DESCRIPTION OF THE PREFERRED EMBODIMENTS

Figure 1:
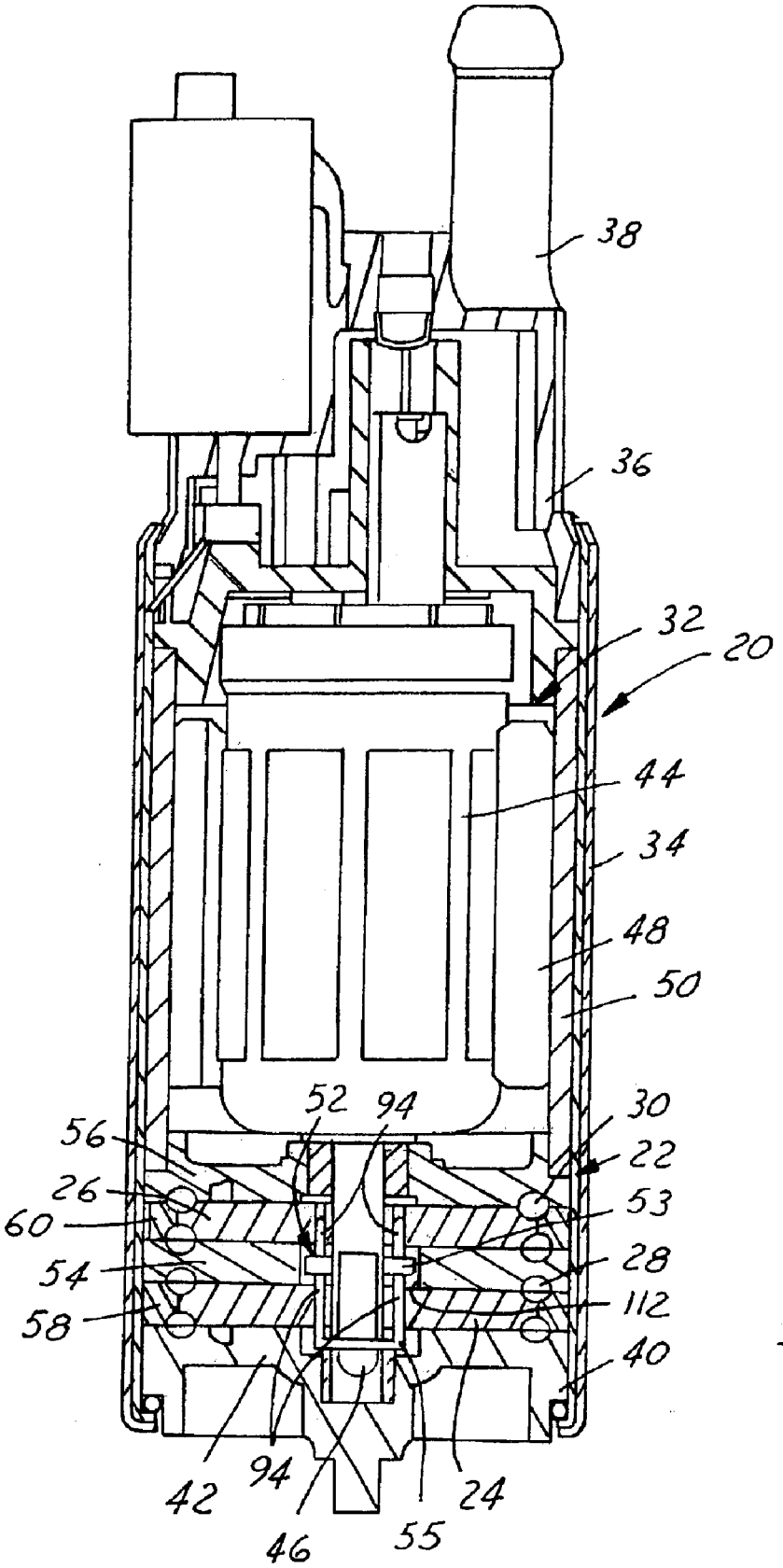
FIG. 1 is a cross-sectional view of a fuel pump according to a first embodiment of the invention.
Figure 2:
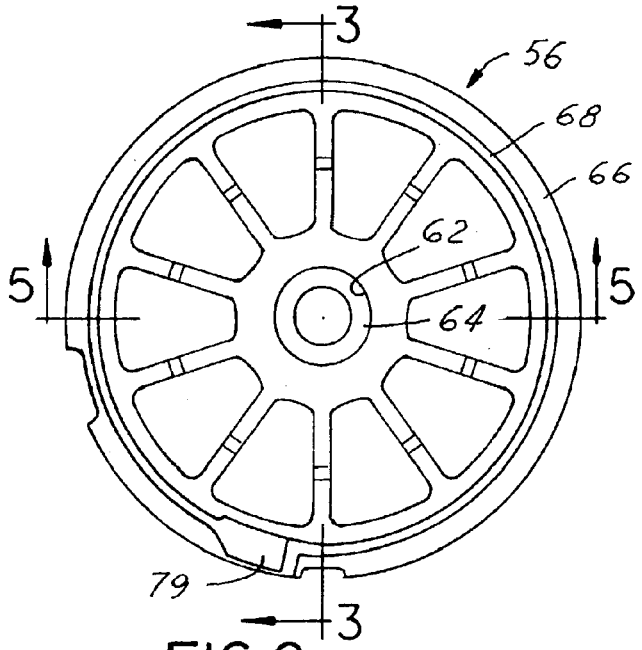
FIG. 2 is a top view of an upper plate of the fuel pump of FIG. 1.
Figure 3:
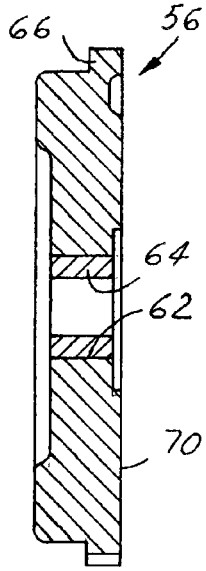
FIG. 3 is a cross-sectional view taken generally along line 3—3 in FIG. 2.
Figure 4:
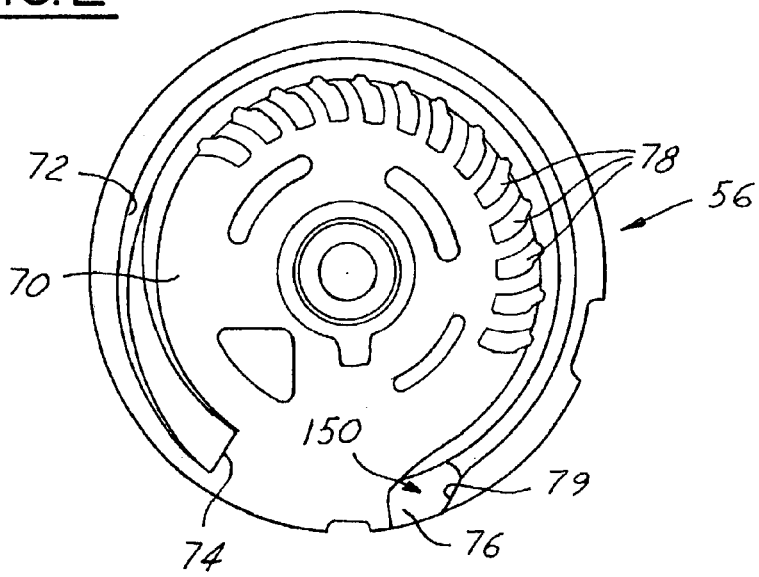
FIG. 4 is a bottom view of the upper plate.
Figure 5:
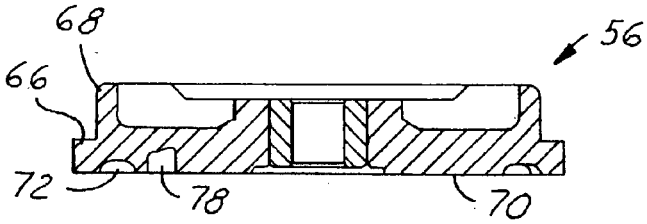
FIG. 5 is a cross-sectional view taken generally along line 5—5 in FIG. 2.

Referring in more detail to the drawings, FIGS. 1–17 illustrate a multi-stage fuel pump, shown here as a two-stage fuel pump 20, according to one embodiment of the present invention. As best shown in FIG. 1, the fuel pump 20 has a pump assembly 22 with a first stage impeller 24 which increases the pressure of fuel and delivers it to a second stage impeller 26 which further increases the pressure of fuel before discharging it for delivery to an engine. The first and second impellers 24, 26 define at least in part first and second fuel pumping channels, 28, 30 respectively. The second fuel pumping channel 30 is circumferentially offset from the first pumping channel 28 to at least partially offset the reaction forces caused by the pressurized fuel within the pump assembly 22 of the fuel pump 20.

The fuel pump 20 has a housing with an outer shell 34 that has a pair of open ends one of which receives an outlet end cap 36 containing an outlet 38 of the fuel pump 20. The other end of the shell 34 is preferably rolled around a circumferential shoulder 40 of a lower plate 42 of the pump assembly 22. Received in the housing is a drive assembly 32 that has an electric motor with a rotor 44 journalled by a shaft 46 for rotation within a permanent magnet stator 48 received within a flux tube 50. The rotor 44 is coupled to the first and second impellers 24, 26 by the shaft 46 and a clip assembly 52. As shown, the clip assembly 52 has a first portion 53 coupled to the shaft 46 and the second impeller 26 to drive the second impeller 26. The shaft 46 may have a non-circular periphery and a through hole in the first portion 53 is adapted so that the first portion 53 engages the non-circular shaft so that the first portion 53 rotates with the shaft 46. A second portion 55 of the clip assembly 52 is coupled to the first impeller 24 and the first portion 53 of the clip assembly 52 to drive the first impeller 24 as the shaft 46 rotates. Of course, the impellers may be coupled to the shaft in other ways, with or without a clip or clip assembly.

The pump assembly 22 has the lower plate 42, the first impeller 24, an intermediate plate 54, the second impeller 26 and an upper plate 56. Preferably, guide rings 58, 60 are disposed each surrounding one of the first and second impellers 24, 26, respectively, with one guide ring 58 between the lower plate 42 and intermediate plate 54 and the other guide ring 60 between the intermediate plate 54 and upper plate 56. Thus, as shown, the first pumping channel 28 is defined between the lower plate 42, intermediate plate 54, guide ring 58 and first impeller 24. The second pumping channel 30 is defined between the intermediate plate 54, upper plate 56, guide ring 60 and second impeller 26.

As shown in FIGS. 2–5, the upper plate 56 has a central through hole 62 in which a bearing 64 is received to journal the shaft 46. The bearing may be integrally formed with the upper plate 56, or may be a separate piece fitted into the hole 62. A radially outwardly extending flange 66 and an annular upstanding wall 68 receive the lower end of the flux tube 50 in assembly. The upper plate 56 preferably has a generally planar lower surface 70 disposed adjacent to the second impeller 26 and the guide ring 60 in assembly. An arcuate groove 72 formed in the lower surface 70 defines in part the second pumping channel 30. One end 74 of the arcuate groove 72 is disposed adjacent to the inlet of the second pumping channel 30 and the other end 76 of the groove 72 is disposed adjacent to the outlet of the second pumping channel 30. A plurality of generally axially extending and circumferentially spaced recesses 78 may be formed in the lower surface 70 opening into the groove 72 at one end and extending radially inwardly from the groove 72. These recesses 78 may be constructed as disclosed in U.S. Pat. No. 5,257,916; the disclosure of which is incorporated herein by reference in its entirety. An opening 79 through the upper plate 56 communicates the outlet of the second pumping channel with the interior of the housing downstream of the pump assembly 22.

Figure 6:
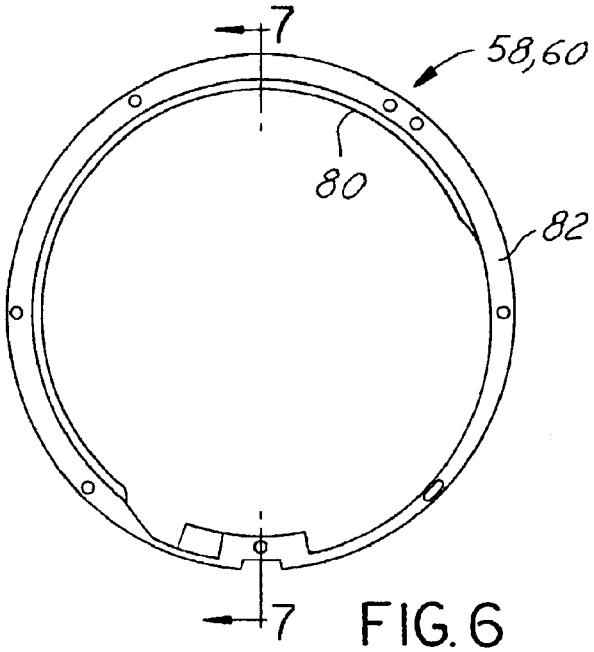
FIG. 6 is a plan view of a guide ring.
Figure 7:
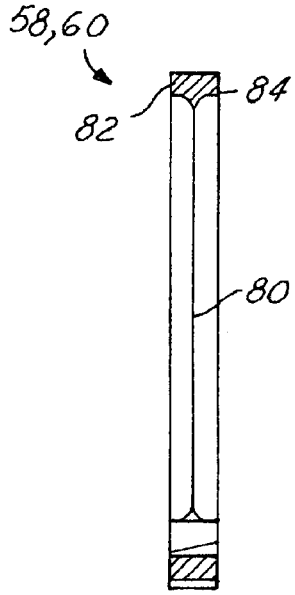
FIG. 7 is a cross-sectional view taken generally along line 7—7 in FIG. 6.

The guide rings 58, 60 of the pump assembly 22 are shown in FIGS. 6 and 7. Both guide rings 58, 60 may be of identical construction. As shown, the guide rings 58, 60 are annular and of a predetermined thickness to control the spacing between the adjacent plates to permit rotation of the impellers 24, 26 between the plates. Each guide ring 58, 60 surrounds its respective impeller 24, 26 and preferably has a radially inwardly extending rib 80 disposed generally midway between opposed planar faces 82, 84 of the guide ring.

Figure 8:
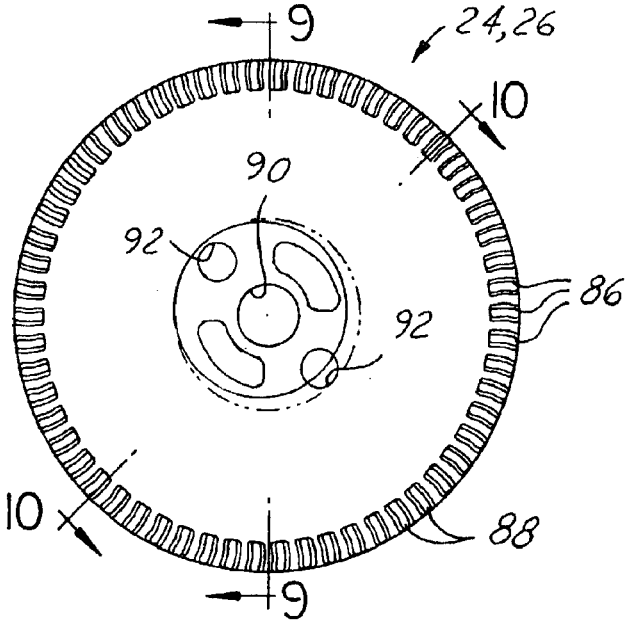
FIG. 8 is a plan view of an impeller of the fuel pump in FIG. 1.
Figure 9:
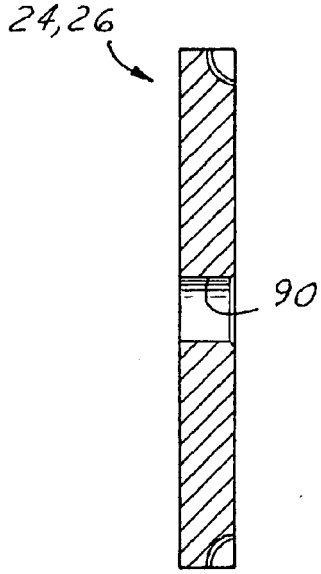
FIG. 9 is a cross-sectional view taken generally along line 9—9 in FIG. 8.
Figure 10:
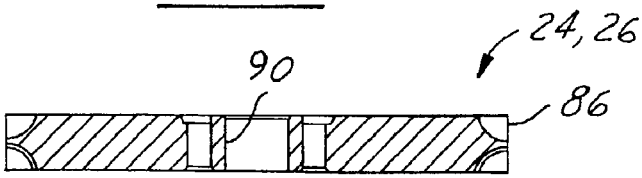
FIG. 10 is a cross-sectional view taken generally along line 10—10 in FIG. 8.

As shown in FIGS. 8–10, the first and second impellers 24, 26 may be of identical construction. In the form shown, the impellers 24, 26 are generally flat circular disks with a plurality of generally radially extending vanes 86 about their periphery. The vanes 86 define pockets 88 in which fuel in the respective pumping channels is received, and rotation of the impellers thereby moves fuel through the pumping channels. The impellers 24, 26 also have a central through hole 90 which receives the shaft 46 and preferably one or more radially spaced openings 92 which receive drive members or fingers 94 of the clip assembly 52 that couples the impellers to the shaft. Alternatively, for example without limitation, the impellers 24, 26 may have a non-circular central hole complementary to a non-circular shaft to couple the impellers to the shaft. As shown, the impellers 24, 26 have one or more openings 92 radially spaced from the central hole 90 with each such opening 92 adapted to receive a separate finger 94 (FIG. 1) of the clip assembly 52. The impellers 24, 26 can be formed in substantially any manner, and may have vanes constructed and arranged differently from that shown. For example, without limitation, the vanes may be disposed inwardly from the periphery of the impeller, the vanes may be formed so that the pockets are open to only one face of the impeller, and the impellers 24, 26 may be of different construction with different vane types or arrangements.

Figure 12:
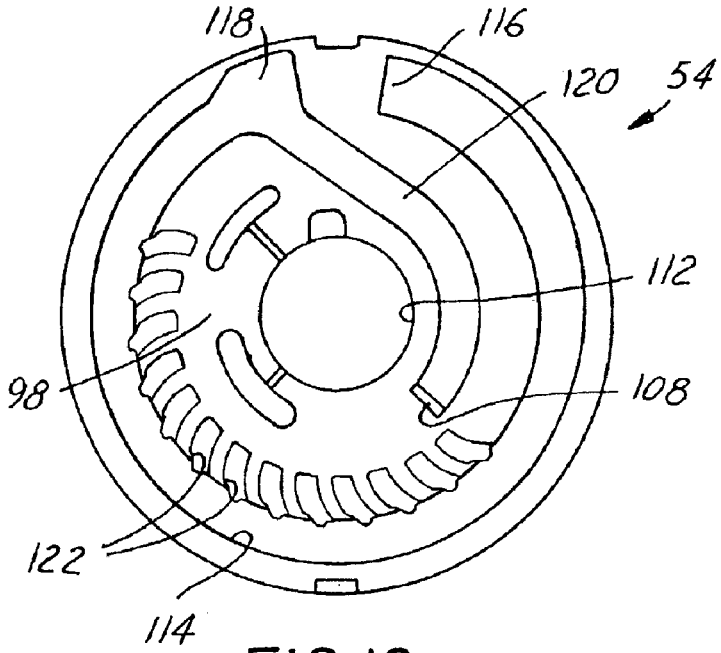
FIG. 12 is a bottom view of the intermediate plate.
Figure 11:
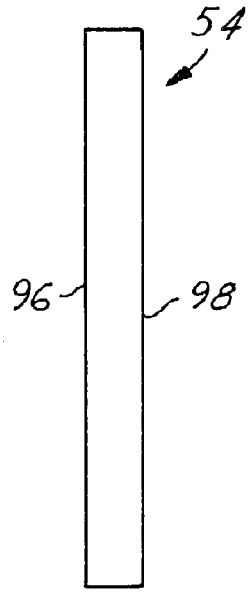
FIG. 11 is a side view of an intermediate plate of the fuel pump of FIG. 1.
Figure 13:
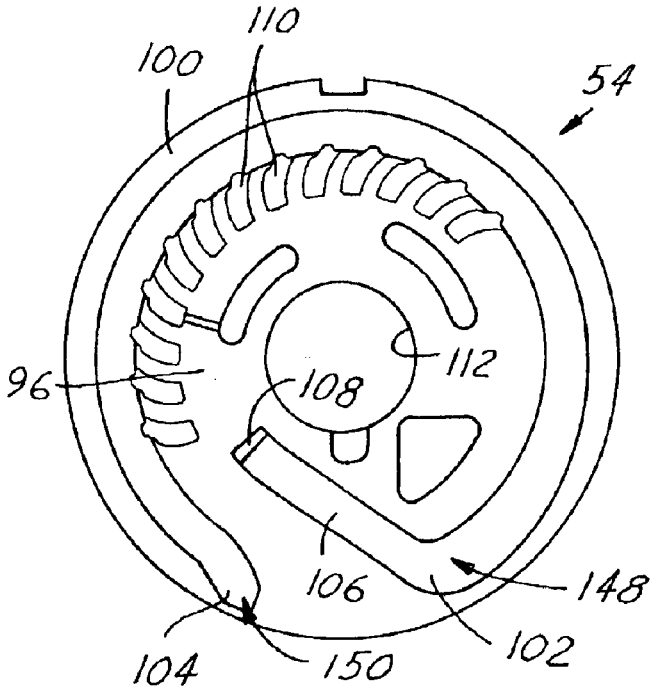
FIG. 13 is a top view of the intermediate plate.
Figure 16:
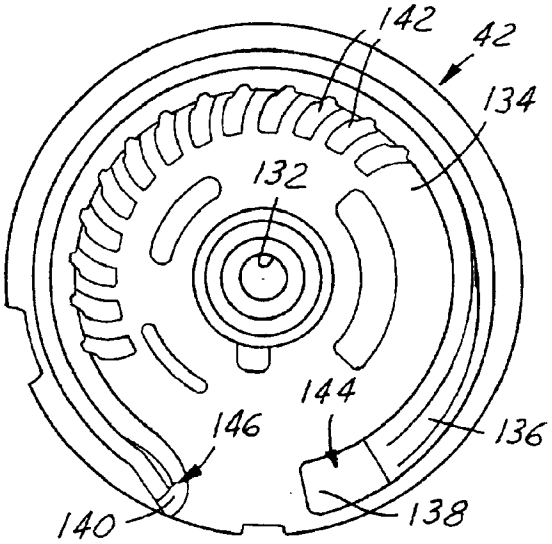
FIG. 16 is a top view of the lower plate.
Figure 14:
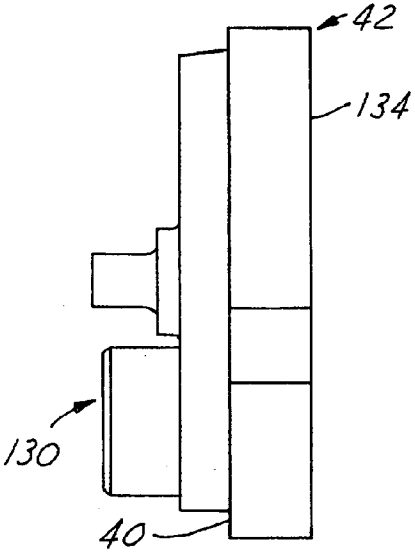
FIG. 14 is a side view of a lower plate of the fuel pump of FIG. 1.
Figure 15:
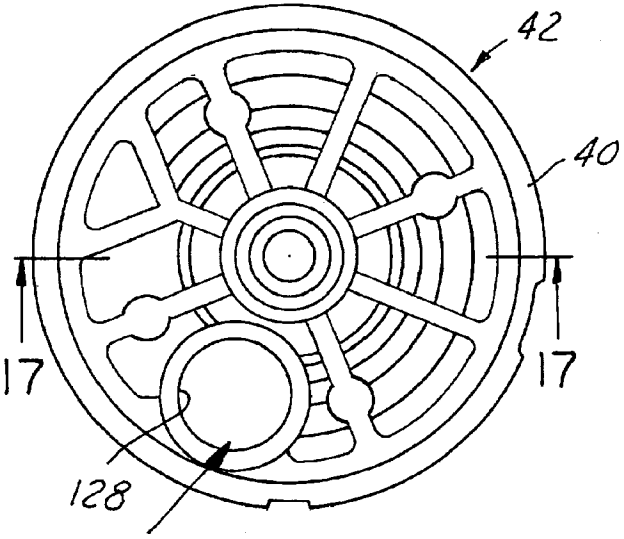
FIG. 15 is a bottom view of the lower plate.
Figure 17:
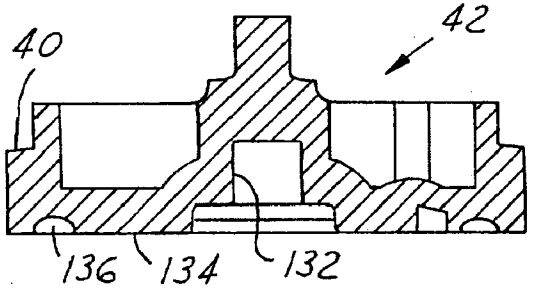
FIG. 17 is a cross-sectional view taken generally along line 17—17 in FIG. 15.

As shown in FIGS. 11–13, the intermediate plate 54 is preferably a generally flat circular disk with opposed, planar upper and lower faces 96, 98. The upper face 96 is disposed adjacent to the guide ring 60 and the second impeller 26 and the lower face 98 is disposed adjacent to the guide ring 58 and the first impeller 24. As shown in FIG. 13, an arcuate groove 100 is preferably formed in the upper face 96 of the intermediate plate 54 to define in part the second pumping channel 30. The arcuate groove 100 preferably has one end 102 generally adjacent to the inlet of the second pumping channel 30 and another end 104 generally adjacent to the outlet of the second pumping channel 30. A transitional groove portion 106 leads from the end 102 of the groove 100 adjacent to the inlet of the second pumping channel 30 to a hole 108 extending through the intermediate plate 54. In this manner, the hole 108 is communicated with the second pumping channel 30 via the transitional portion 106 and the arcuate groove 100 in the upper surface 96 of the intermediate plate 54. Generally axially extending and circumferentially spaced recesses 110 may be formed adjacent to the arcuate groove 100, as generally described with reference to the upper plate 56. A central hole 112 through the intermediate plate 54 receives the shaft 46 and associated portions of the clip assembly 52.

As best shown in FIG. 12, in the lower surface 98 of the intermediate plate 54, a second arcuate groove 114 is formed which defines in part the first pumping channel 28. The second arcuate groove 114 has one end 116 generally adjacent to the inlet of the first pumping channel 28 and another end 118 generally adjacent to the outlet of the first pumping channel 28. A transitional groove portion 120 extends from the end 118 of the second arcuate groove 114 that is adjacent to the outlet of the first pumping channel 28 to the hole 108 through the intermediate plate 54. Accordingly, the hole 108 is communicated with the first pumping channel 28 via the transitional portion 120 and the second arcuate groove 114 in the lower surface 98 of the intermediate plate 54. A plurality of radially extending and circumferentially spaced recesses 122 may be formed in the lower surface 98 of the intermediate plate 54 as described with reference to the upper surface 96.

As shown in FIGS. 14–17, the lower plate 42 has an opening 128 defining an inlet 130 of the fuel pump 20 through which fuel is received from a fuel tank. A blind bore 132 in the lower plate 42 receives the end of the shaft 46 and may having a bearing disposed therein, such as a ball bearing or other bearing surface. The lower plate 42 preferably has a generally planar upper surface 134 adjacent to which the guide ring 58 and first impeller 24 are received in assembly. A generally arcuate groove 136 is formed in the upper surface 134 of the lower plate 42 to define in part the first pumping channel 28. The arcuate groove 136 preferably has one end 138 generally adjacent to inlet 130 of the first pumping channel 28 and another end 140 generally adjacent to the outlet of the first pumping channel 28. Axially extending and circumferentially spaced recesses 142 may be formed in the upper surface 134 of the lower plate 42 as discussed with reference to the other plates.

Accordingly, as shown in FIGS. 1–17 the first pumping channel 28 is defined by the arcuate groove 136 in the lower plate 42, the guide ring 58, the first impeller 28, and the arcuate groove 114 formed in the lower face 98 of the intermediate plate 54. An inlet 144 of the first pumping channel 28 is defined generally in the area of the end 138 of groove 136 and the end 116 of groove 114. An outlet 146 of the first pumping channel 28 is defined generally in the area of the end 140 of the groove 136 and the end 118 of the groove 114. Similarly, the second pumping channel 30 is defined by the arcuate groove 100 formed in the upper face 96 of the intermediate plate 54, the guide ring 60, the second impeller 26, and the groove 72 formed in the upper plate 56. An inlet 148 of the second pumping channel 30 is defined generally in the area of the end 102 of groove 100 and the end 74 of groove 72. An outlet 150 of the second pumping channel 30 is defined generally in the area of the end 104 of groove 100 and the end 76 of groove 72. Preferably, each pumping channel spans an angle of less than 360°, and preferably more than 300°.

As shown, the second fuel pumping channel 30 is circumferentially offset from the first fuel pumping channel 28. Desirably, the inlet 148 of the second pumping channel 30 is offset from the inlet 144 of the first pumping channel 28 by between about 60°–240°, and preferably between 150°–210°. Likewise, the outlet 150 of the second pumping channel 30 is desirably offset from the outlet 146 of the first pumping channel 28 by between about 60°–240°, and preferably between 150°–210°. Because the second fuel pumping channel 30 is circumferentially offset from the first fuel pumping channel 28, the transition portions 106 and 120 formed in the intermediate plate 54 are constructed and arranged to communicate the outlet 146 of the first pumping channel 28 with the inlet 148 of the second pumping channel 30 via the hole 108 in the intermediate plate 54.

Thus, the first pumping channel 28 and second pumping channel 30 are arranged in series. Fuel enters the pumping assembly via the fuel inlet 130 which leads to the inlet 144 of the first pumping channel 28, fuel is then moved to the outlet 146 of the first pumping channel 28, through the intermediate plate 54, into the inlet 148 of the second pumping channel 30 and then finally out of the outlet 150 of the second pumping channel 30 where it flows up through the fuel pump housing 32 and ultimately out of the fuel pump outlet 38. As shown, the first and second fuel pumping channels 28, 30 are formed adjacent to the periphery of the plates 42, 54, 56 and the first and second impellers 24, 26, and the hole 108 through the intermediate plate 54 is disposed radially inwardly of the pumping channels 28, 30.

Figure 18:
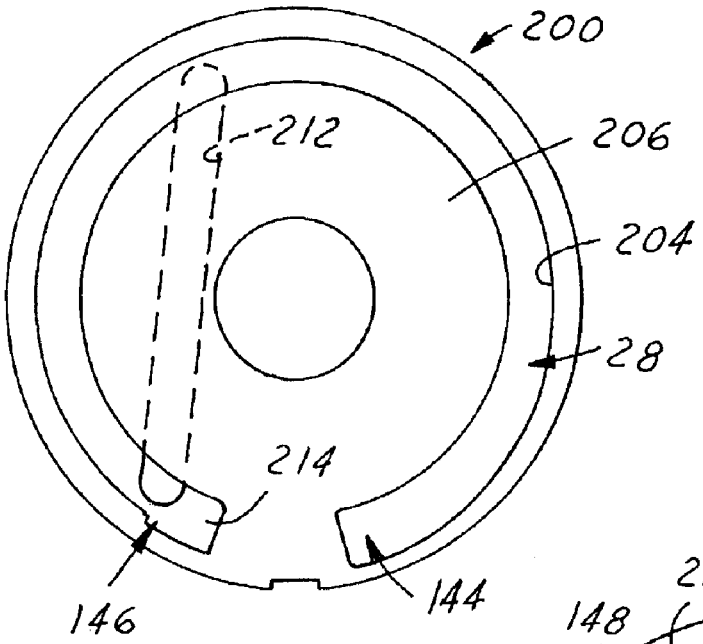
FIG. 18 is a bottom view of an intermediate plate of a fuel pump according to an alternate embodiment.
Figure 19:
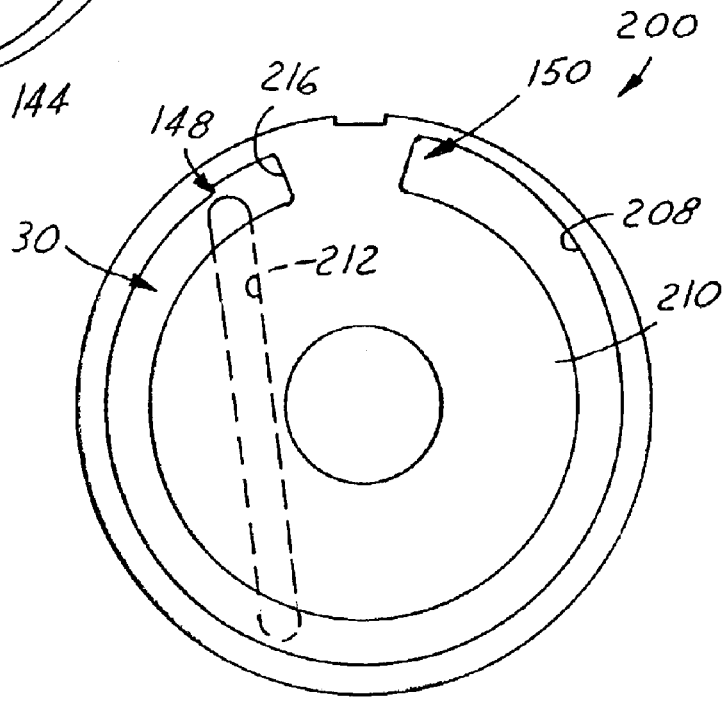
FIG. 19 is a top view of the intermediate plate of FIG. 18.

As shown in FIGS. 18–19, a fuel pump according to a second embodiment of the present invention has an intermediate plate 200 with an arcuate groove 204 in its lower surface 206, shown in FIG. 18, that defines in part the first fuel pumping channel 28. An arcuate groove 208 in the upper surface 210 of the intermediate plate 200, shown in FIG. 19, defines in part the second fuel pumping channel 30. To communicate the outlet 146 of the first pumping channel 28 with the inlet 148 of the second pumping channel 30, a passage 212 extends through the intermediate plate 200. The passage 212 communicates one end 214 of the arcuate groove 204 in the lower surface 206 that is adjacent to the outlet 146 of the first pumping channel 28 with one end 216 of the arcuate groove 208 in the upper surface 210 that is in the area of the inlet 148 of the second pumping channel 30. Of course, many other arrangements of grooves and/or passages in, through and around the intermediate plate may be employed to communicate the first pumping channel 28 with the second pumping channel 30.

In each embodiment of the fuel pump, the first pumping channel 28 and second pumping channel 30 are circumferentially offset. Desirably, the offset fuel pumping channels can offset or balance at least to some extent the forces acting on the fuel pump assembly 22 due to the varying pressure of fuel within the pump assembly 22. For example, fuel at an outlet of a pumping channel is at a much greater pressure then fuel at the inlet of that pumping channel. Hence, a side load and torque is experienced in the pump assembly 22 components, including the shaft 46 which drives the impellers 24, 26. With the specific embodiments disclosed, the radial or side load forces acting on the shaft 46 through the impellers 24, 26 can be oriented in a manner in which the force from one impeller at least partially offsets the force from the other impeller. The torsional forces on the impellers can be arranged so that they compliment each other and preferably tend to rotate the impellers and shaft in the same direction of rotation as the rotor 48 of the electric motor.

As viewed in FIG. 18, the net side load force in the first pumping channel 28 would act from the left to the right across the intermediate plate as shown from the outlet side 146 toward the inlet side 144. In FIG. 19, the net side load force in the second pumping channel acts from the right to the left across the intermediate plate as shown (from the outlet side 150 towards the inlet side 148). Hence, relative to the shaft, these side load forces tend to offset each other, at least in part. Desirably, this may permit use of a shaft of reduced strength or hardness due to the reduction of the side or radial forces on the shaft. Further, due at least in part to the reduced net axial forces in the fuel pump assembly, the pumping elements can be manufactured with larger tolerances and potentially without requiring secondary machining operations such as lapping or grinding.

Persons of ordinary skilled in the art will readily recognize that the preceding description of the preferred embodiments of the present invention is illustrative of the present invention rather than limiting. Alterations and modifications may be made to the various elements of the fuel pump without departing from the spirit and scope of the present invention. For example, and without limitation, the pumping elements may be constructed in a manner other than specifically disclosed, and the plates may have peripheral rims or other structures that obviate the need for a separate guide ring surrounding the pumping elements. Again, other modifications may also be made within the spirit and scope of the present invention.

What is claimed is:

1. A fuel pump, comprising:

a drive assembly;

a pump assembly having a lower plate, an intermediate plate, an upper plate, a first pumping element disposed between the lower plate and the intermediate plate and driven for rotation by the drive assembly, and a second pumping element disposed between the intermediate plate and the upper plate and driven for rotation by the drive assembly;

a first pumping channel defined at least in part by the first pumping element, having an inlet through which fuel is received at a first pressure and an outlet through which fuel is discharged at a second pressure higher than the first pressure; and a second pumping channel defined at least in part by the second pumping element, having an inlet through which fuel is received generally at the second pressure and an outlet through which fuel is discharged at a third pressure higher than the second pressure, wherein the inlet of the second pumping channel is circumferentially offset from the inlet of the first pumping channel, the outlet of the second pumping channel is circumferentially offset from the outlet of the first pumping channel, and at least one of the first pumping channel and the second pumping channel leads to a transition portion that is defined at least in part between the intermediate plate and a corresponding one of the first pumping element and second pumping element, and is disposed between the outlet of the first pumping channel and the inlet of the second pumping channel.

2. The fuel pump of claim 1 wherein the first pumping channel inlet is offset from the second pumping channel inlet by between 60 and 240 degrees.

3. The fuel pump of claim 1 wherein the first pumping channel inlet is offset from the second pumping channel inlet by between 150 and 210 degrees.

4. The fuel pump of claim 1 wherein the first pumping channel outlet is offset from the second pumping channel outlet by between 60 and 240 degrees.

5. The fuel pump of claim 1 wherein the first pumping channel outlet is offset from the second pumping channel outlet by between 150 and 210 degrees.

6. The fuel pump of claim 1 wherein the first and second pumping channels are defined at least in part by arcuate grooves defined in the pump assembly, and the first and second pumping channels each span an angle of over 300 degrees between their respective inlets and outlets.

7. The fuel pump of claim 1 wherein the intermediate plate has a through hole communicating the first pumping channel and the second pumping channel.

8. The fuel pump of claim 7 wherein the through hole communicates with the outlet of the first pumping channel and the inlet of the second pumping channel.

9. The fuel pump of claim 1 wherein at least one of the first pumping element and the second pumping element is an impeller having a plurality of circumferentially spaced vanes disposed generally adjacent to the periphery of the impeller.

10. The fuel pump of claim 9 wherein the vanes extend generally radially outwardly about the periphery of the impeller.

11. The fuel pump of claim 10 wherein both the first pumping element and second pumping elements are impellers.

12. The fuel pump of claim 1 wherein the intermediate plate has a through hole that communicates with the transition portion and is radially spaced from at least one of the first pumping channel and the second pumping channel.

13. The fuel pump of claim 1 wherein at least a portion of the transition portion that is defined between the intermediate plate and one of the first and second pumping elements is radially spaced from the associated pumping channel.

14. A fuel pump, comprising:

a drive assembly;

a pump assembly having a lower plate, an intermediate plate, an upper plate, a first pumping element disposed between the lower plate and the intermediate plate and driven for rotation by the drive assembly, and a second pumping element disposed between the intermediate plate and the upper plate and driven for rotation by the drive assembly;

a first pumping channel defined at least in part by the first pumping element, having an inlet through which fuel is received at a first pressure and an outlet through which fuel is discharged at a second pressure higher than the first pressure; and a second pumping channel defined at least in part by the second pumping element, having an inlet through which fuel is received generally at the second pressure and an outlet through which fuel is discharged at a third pressure higher than the second pressure, wherein the inlet of the second pumping channel is circumferentially offset from the inlet of the first pumping channel, the outlet of the second pumping channel is circumferentially offset from the outlet of the first pumping channel, the intermediate plate has a through hole communicating the first pumping channel and the second pumping channel, the intermediate plate has a generally planar lower surface with an arcuate groove formed in its lower surface to define at least in part the first pumping channel, the groove in the lower surface of the intermediate plate spans from the inlet of the first pumping channel to the outlet of the first pumping channel, and has a transition portion extending from the region of the outlet of the first pumping channel to the through hole.

15. The fuel pump of claim 14 wherein the through hole of the intermediate plate is disposed radially inwardly from the first pumping channel.

16. A fuel pump, comprising:

a drive assembly;

a pump assembly having a lower plate, an intermediate plate, an upper plate, a first pumping element disposed between the lower plate and the intermediate plate and driven for rotation by the drive assembly, and a second pumping element disposed between the intermediate plate and the upper plate and driven for rotation by the drive assembly;

a first pumping channel defined at least in part by the first pumping element, having an inlet through which fuel is received at a first pressure and an outlet through which fuel is discharged at a second pressure higher than the first pressure; and a second pumping channel defined at least in part by the second pumping element, having an inlet through which fuel is received generally at the second pressure and an outlet through which fuel is discharged at a third pressure higher than the second pressure, wherein the inlet of the second pumping channel is circumferentially offset from the inlet of the first pumping channel, the outlet of the second pumping channel is circumferentially offset from the outlet of the first pumping channel, the intermediate plate has a through hole communicating the first pumping channel and the second pumping channel, the intermediate plate has a generally planar upper surface with an arcuate groove formed in the upper surface to define at least in part the second pumping channel, the groove in the upper surface of the intermediate plate spans from the inlet of the second pumping channel to the outlet of the second pumping channel, and has a transition portion extending from the region of the inlet of the second pumping channel to the through hole.

17. The fuel pump of claim 16 wherein the through hole of the intermediate plate is disposed radially inwardly from the second pumping channel.

18. A fuel pump assembly, comprising:

a first pumping channel with an inlet through which fuel is received at a first pressure and an outlet through which fuel is discharged at a second pressure higher than the first pressure, a second pumping channel with an inlet through which fuel is received and an outlet through which fuel is discharged at a third pressure higher than the second pressure, the inlet of the second pumping channel being circumferentially offset from the inlet of the first pumping channel and the outlet of the second pumping channel being circumferentially offset from the outlet of the first pumping channel, and an intermediate plate disposed generally between the first pumping channel and the second pumping channel, having a passage communicating the first pumping channel with the second pumping channel and having a groove formed therein that defines at least part of a transition portion extending from the passage to one of the region of the outlet of the first pumping channel and the region of the inlet of the second pumping channel.

19. The fuel pump assembly of claim 18 wherein the passage includes a hole that is radially spaced from at least one of the first pumping channel and the second pumping channel.

20. The fuel pump assembly of claim 18 wherein at least part of the transition portion extends from one end of one of the first and second pumping channels generally circumferentially beyond the other end of said one of the first and second pumping channels.

* * * * *